US008757693B2

(12) United States Patent
Fuller et al.

(10) Patent No.: US 8,757,693 B2
(45) Date of Patent: Jun. 24, 2014

(54) HOISTING DEVICE

(75) Inventors: Harry P. Fuller, Newbury, OH (US); Sean A. Stapulionis, South Russell, OH (US); Touby Khamphilapanyo, Garfield Heights, OH (US); Darel R. Taylor, Concord, OH (US)

(73) Assignee: Jergens, Inc., Cleveland, OH (US)

( * ) Notice: Subject to any disclaimer, the term of this patent is extended or adjusted under 35 U.S.C. 154(b) by 0 days.

(21) Appl. No.: 13/618,303

(22) Filed: Sep. 14, 2012

(65) Prior Publication Data

US 2013/0082477 A1 Apr. 4, 2013

Related U.S. Application Data

(60) Provisional application No. 61/541,638, filed on Sep. 30, 2011.

(51) Int. Cl.
*B66C 1/66* (2006.01)

(52) U.S. Cl.
USPC ..... 294/215; 294/82.1; 403/78; 403/164

(58) Field of Classification Search
USPC ..... 294/215, 82.1; 403/78, 164
See application file for complete search history.

(56) References Cited

U.S. PATENT DOCUMENTS

| | | | | |
|---|---|---|---|---|
| 2,625,005 | A * | 1/1953 | Myers | 59/95 |
| 2,633,375 | A * | 3/1953 | Wilcoxon | 403/6 |
| 3,492,033 | A | 1/1970 | Mueller | |
| 4,708,382 | A * | 11/1987 | LaCount | 294/82.1 |
| 5,286,130 | A * | 2/1994 | Mueller | 403/79 |
| 5,634,734 | A | 6/1997 | Schron, Jr. et al. | |
| 6,017,071 | A * | 1/2000 | Morghen | 294/94 |
| 6,022,164 | A * | 2/2000 | Tsui et al. | 403/78 |
| 6,039,500 | A * | 3/2000 | Kwon | 403/78 |
| 6,068,310 | A | 5/2000 | Fuller et al. | |
| 6,443,514 | B1 | 9/2002 | Fuller et al. | |
| 6,652,012 | B1 | 11/2003 | Fuller et al. | |

(Continued)

FOREIGN PATENT DOCUMENTS

| | | | |
|---|---|---|---|
| DE | 20 2005 019356 | U1 | 2/2006 |
| DE | 20 2005 019357 | U1 | 2/2006 |
| DE | 20 2006 006886 | U1 | 7/2006 |

OTHER PUBLICATIONS

International Search Report and Written Opinion dated Nov. 7, 2012 in corresponding International Patent Application No. PCT/US2012/055520, filed Sep. 14, 2012.

*Primary Examiner* — Dean Kramer
(74) *Attorney, Agent, or Firm* — Rankin, Hill & Clark LLP

(57) ABSTRACT

A hoisting device and method of making the same including a hoist body having an inwardly extending post pocket that includes an inwardly facing body groove extending about a post pocket axis. The hoist body further includes an access opening in communication with the body groove. The hoisting device further including a post having a post head that has an outwardly extending post groove configured to functionally align with the body groove of the body such that the two groove are in functional alignment with one another when in an assembled position. The access opening allowing a plurality of bearings to be directed into the bearing groove when the post is in assembled position within the bearing pocket. The hoist device further includes a plug to selectively close the access opening thereby maintaining the plurality of bearings in the bearing grooves.

19 Claims, 6 Drawing Sheets

(56) References Cited

U.S. PATENT DOCUMENTS

| | | | | |
|---|---|---|---|---|
| 7,891,903 | B2 | 2/2011 | Klingenberg et al. | |
| 7,914,225 | B2 | 3/2011 | Hageman | |
| 2005/0017522 | A1* | 1/2005 | Smetz | 294/1.1 |
| 2005/0069379 | A1* | 3/2005 | Smetz | 403/164 |
| 2009/0208274 | A1* | 8/2009 | Liang | 403/164 |
| 2010/0207406 | A1* | 8/2010 | Thomeczek | 294/1.1 |

* cited by examiner

HOISTING DEVICE

This application claims priority in Provisional Patent Application Ser. No. 61/541,638 that was filed on Sep. 30, 2011, which is incorporated by reference herein.

The invention of this application relates to hoisting device and, more particularly, to a new hoisting device that can be easily assembled with a minimal amount of parts and that is effective in operation. Further, the invention of this application provides the strength of a traditional hoist ring with the versatility of a shackle. Yet even further, the invention of this application includes a strong design that is also smooth in operation under load.

BACKGROUND OF THE INVENTION

There are a wide range of lifting and/or hoisting devices used in the industry which include both center-pull style devices and side-pull devices. These devices are used to lift a variety of heavy loads or objects, such as die sets and molds; however, the invention has much broader applications and may be used for a variety of applications where it is necessary to secure a ring to a structure, either to lift the structure or to hold down a structure such as containers, air crafts, air vehicles, boats, etc.

Through the years, a large number of hoisting devices have been developed which allow for a ring to be connected to the hook of a hoist wherein the ring pivots and swivels for the purpose of automatically adjusting the disposition of the ring with respect to the force being applied to the hoist during the lifting procedure. Such devices are found in patents incorporated by reference herein which will be discussed more below.

The center-pull hoist devices have a post assembly that allows 360-degree rotation of a support or body member. The rotating support member carries the load lifting ring, which can be in many forms include the form of a U-shaped clevis. The clevis pivots through a center clevis axis of the rotating support member and has a pivot arc of about 180 degree.

Like the center-pull style, the side-pull hoist ring includes a rotating support member mounted onto the load by a post assembly. In a side-pull hoist ring, the support member can be generally U-shaped to define an outer bite portion in which a circular load ring is pivotally mounted. The circular load ring is offset from the axis of the center post assembly.

These prior patents include the device shown in Schron Jr. et al U.S. Pat. No. 5,634,734 that discloses a center-pull style hoist device and is incorporated by reference for showing the same.

Fuller et al U.S. Pat. No. 6,652,012; Fuller et al U.S. Pat. No. 6,443,514; and Fuller et al U.S. Pat. No. 6,068,310 all disclose side-pull hoisting devices and are all incorporated by reference for showing the same.

All of these device disclose effective hoisting devices that have been used effectively in the industry for many years and which are merely provided as background for the invention of this application.

In addition to the above-described hoisting devices, also known in the patent art is a patent to Mueller U.S. Pat. No. 5,286,130, which discloses a clevis assembly. While the Mueller patent is possibly an effective device, it has many limitations and disadvantages that produce a less than ideal lifting device. In this respect, lifting devices are most effective if they are strong and durable and if they can smoothly and accurately secure and/or move a load that can be very heavy. Thus, it is important that the device smoothly and automatically adjust itself when loaded based on the movement of the load. Part of this is the ability to smoothly rotate about the stud or post axis. As is shown in the drawings, Mueller's device includes a fastener 18 having a round cylindrical head portion 18*a* and a shank portion 18*b* defining a threaded lower end 18*c*. Head portion 18*a* has a length or height slightly less than the height of recess 10*e* and is sized to be journalled in recess 10*e*. Shank portion 18*b* has a diameter slightly less than the diameter of the inner periphery 16*d* of collar 16 so that the shank portion may pass loosely through the collar to position the threaded lower end 18*c* of the fastener below the clevis. The threaded engagement between collar 16 and head portion then support the fastener within the recess of body 10. As a result, the friction between the head and the collar makes rotation of the body about the fastener based on metal-on-metal contact that can prevent rotation or at least make rotation difficult and/or non-smooth. In addition, the more torque used to tighten the Mueller hoist, the more friction that will be present between the bolt head and the collar thereby making the rotation of the shackle about the bolt access more restricted. Further, Mueller relies on a threaded collar to support the weight of the load and this collar could loosen over time by the weight and rotation of the load.

In addition, Mueller utilizes a fastener that is completely encased within the body of the clevis assembly wherein the bolt cannot be turned to tighten his device. Conversely, Mueller must utilize a set screw 24 and brass bushing 26 to frictionally engage his bolt head and then the entire assembly must be rotated to tighten fastener 18 into a threaded hole. As can be appreciated, this must be done by hand and a torque determining devices, such as a torque wrench, cannot be used to determine if a desired torque between the clevis assembly and the load has been achieved. However, if the set screw is tightened against bolt head 18*a*, the clevis assembly cannot rotate. As a result, the set screw must then be backed off if his device is to be allowed to rotate about the bolt axis. Nonetheless, Mueller is incorporated by reference as background material.

Similarly, Mueller U.S. Pat. No. 3,492,033 discloses a design that includes metal-on-metal contact to allow for the rotation of the device about the stud or post and support the load. And, this arrangement requires the use of the threaded collar to support the post within the body. This Mueller patent is also incorporated by reference as background material.

SUMMARY OF INVENTION

The invention of this application overcomes the shortcomings in the art by utilizing ball bearings to support the weight of the load and maintain the interengagement between the two primary components.

More particularly, in accordance with an aspect of the present invention provided is a hoisting device that includes a hoist body having an inwardly extending post pocket that includes an inwardly facing bearing groove extending around the post axis. The hoist body further includes an access opening in alignment with the bearing groove. The hoisting device further includes a post having a post head that has an outwardly extending bearing groove configured to align with the inward bearing of the body such that the two grooves are in functional alignment with one another when the post head is in the assembled position within the post pocket. In that the access opening is in alignment with the bearing grooves, a plurality of bearings can be directed into the bearing groove when the post is in the assembled position within the bearing pocket. The hoist device further includes a plug to selectively close the access opening thereby maintaining the plurality of bearings in the bearing grooves.

As a result of this configuration, the bearings maintain the post within the pocket and carry the weight of the load between these two components. In that bearings maintain the load, as opposed to the metal-on-metal contact between a bolt head and a collar, smooth rotation is achieved. Yet even further, the bearings support this load in shear and many bearings combine their respective shear strength to support the overall load. This produces a locking arrangement between the post and the body that is both extremely strong and which has excellent rotational properties. Yet even further, the system is easy to assembly without a lot of components and machining. As can be appreciated, this interengagement does not include costly threads and assembly operations that include both threading components together and locking these threads in that the Mueller device uses his thread to support the load.

According to other aspects of the present invention, the post can further include a collar between the post head and the post threads. The collar can extend about the base of the hoist body wherein the collar is tightened against the load and can be tightened to a high torque without limiting the rotational ability of the hoisting device.

According to yet a further aspect of the present invention, the body can further include a tool opening to allow the passage of a tool into the hoist body and tighten the post into the associated load hole when the post is in the assembled position or condition. As can be appreciated, this allows power tools to be used to tighten the post and allows torque setting devices to torque the post to any desired torque.

These and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
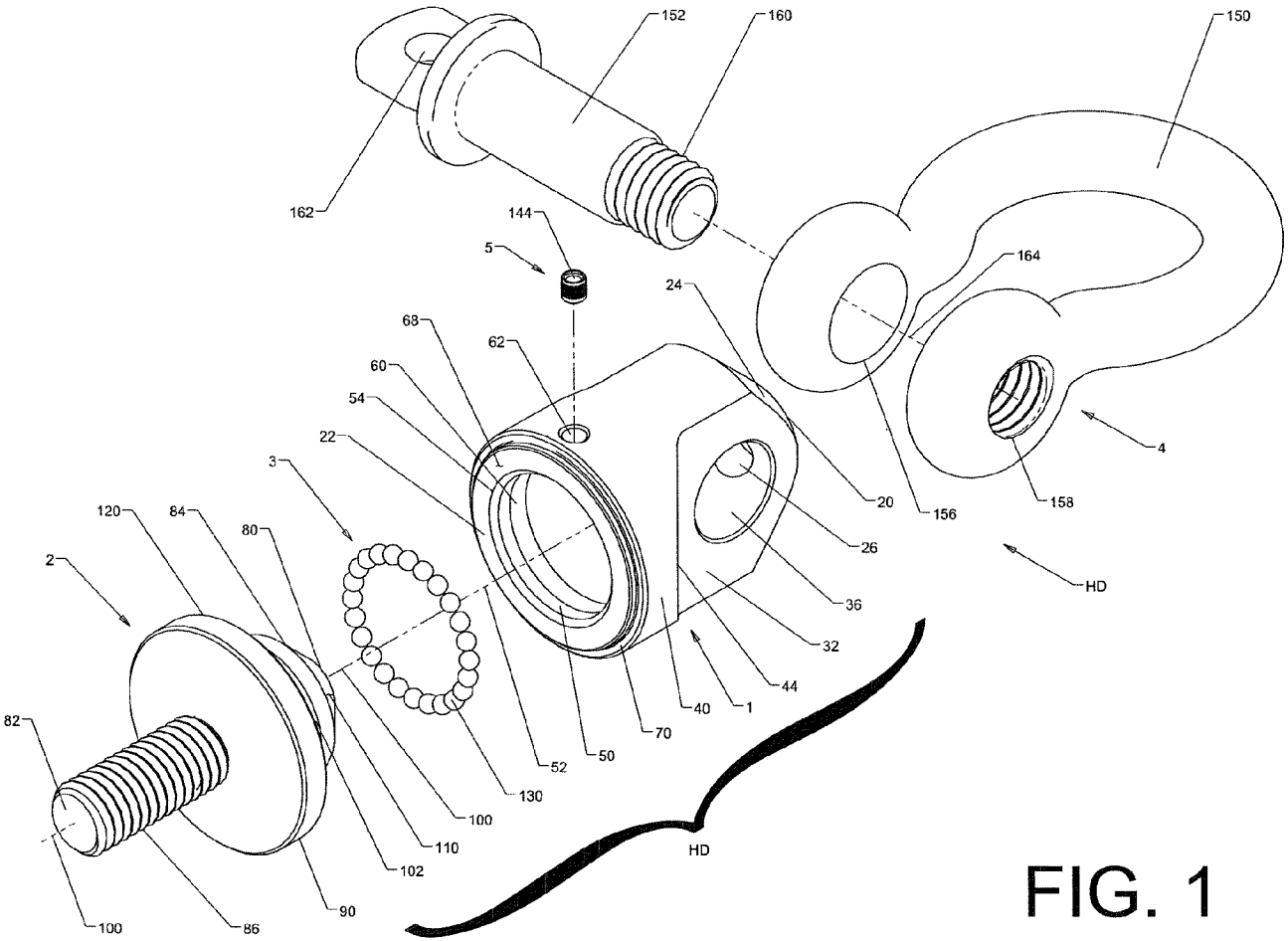
FIG. 1 is an exploded perspective view of certain aspects of the hoisting device of this application.
Figure 3:
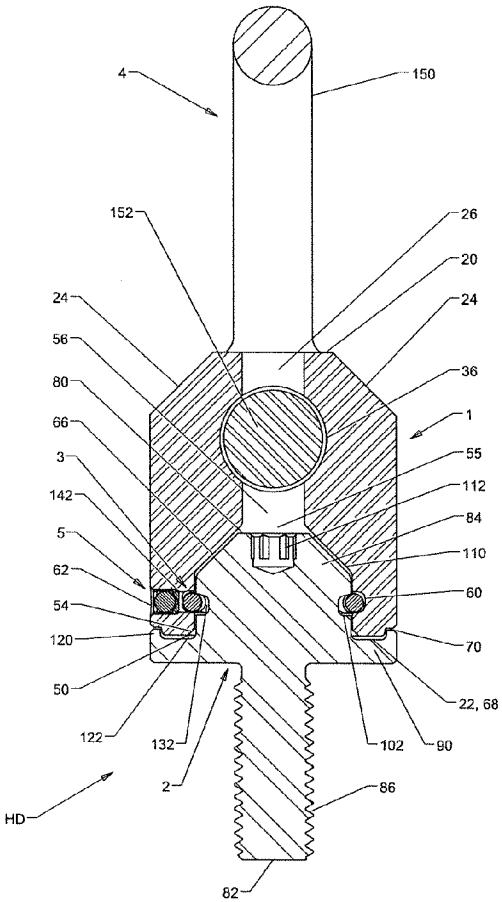
FIG. 3 is a sectional view taken along lines 3-3 in FIG. 2.
Figure 2:
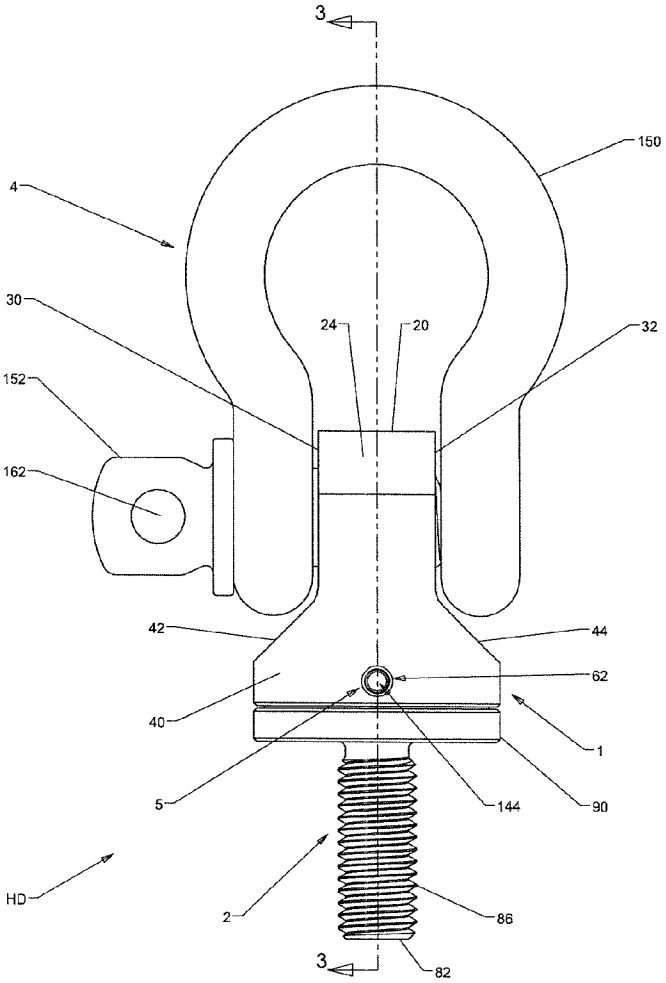
FIG. 2 is a side elevational side view of the hoisting device shown in FIG. 1 in an assembled condition.
Figure 4:
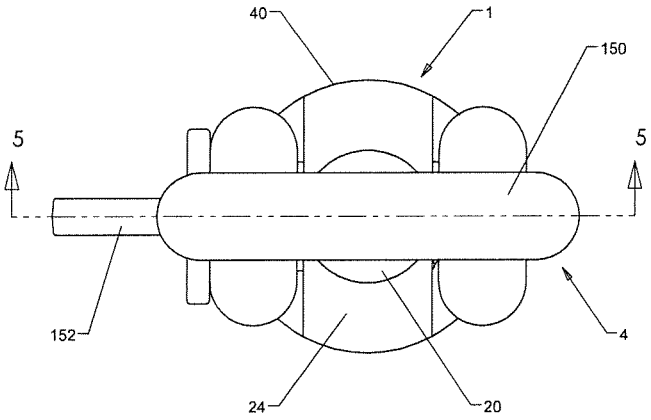
FIG. 4 is a top view of the hoisting device shown in FIG. 1 in the assembled condition or position.
Figure 5:
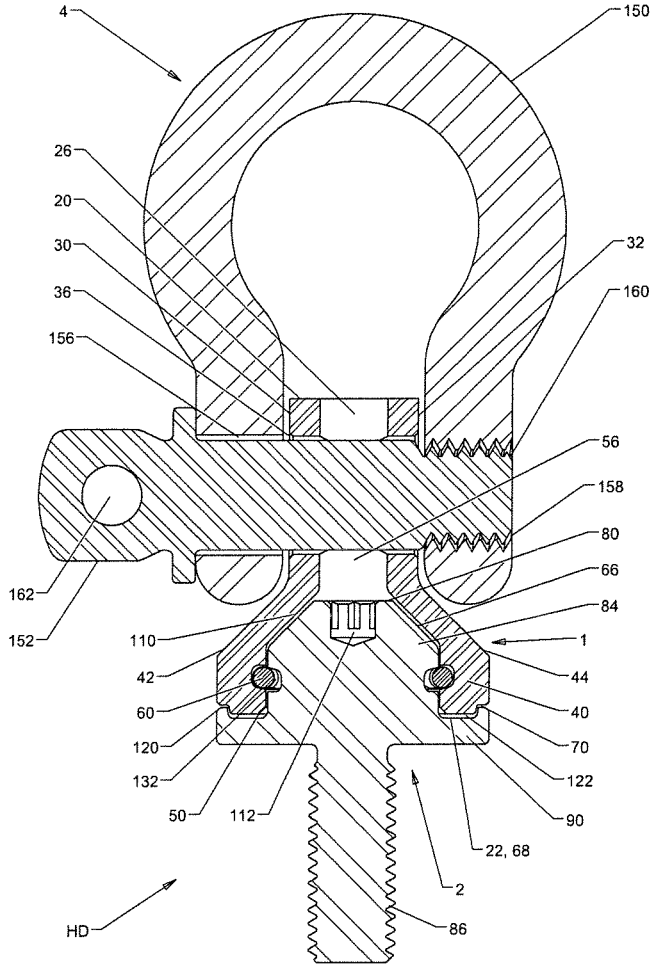
FIG. 5 is a sectional view taken along lines 5-5 in FIG. 4.

Referring now to the drawings wherein the showings are for the purpose of illustrating preferred and alternative embodiments of the invention only and not for the purpose of limiting same, FIGS. 1-5 show several embodiments of a hoisting device HD. Device HD includes a hoist body 1, a stud or post 2, a bearing set 3, a lifting ring 4 (optional), and a plug 5 which will all be discussed in greater detail below.

More, particular, the hoist body 1 extends from a first end 20 to a second end 22 wherein first end 20 can include a tapered portion 24 to provide additional clearance for optional ring 4. First end 20 can further include a tool opening 26. In addition, body 1 can include a necked down portion 30 and 32 having a transverse hole 36 shaped to receive ring 4 which will be discussed in greater detail below. Body 1 further includes a base portion 40 and can include transitions 42 and 44 between the base portion and the necked down portions. Base portion 40 includes a post pocket 50 extending about a pocket axis 52 which extends from pocket opening 54 toward a pocket top 55 that include a tool opening 56. As will be discussed in greater detail below, openings 26 and 56 can function together to allow a tool to access pocket 50 and access post 2.

Pocket 50 further includes an inwardly extending body bearing groove 60 that at least extends partially about pocket axis 52, but preferably extends about the entire axis to create an annular groove. The body has an access opening 62 that is generally aligned with groove 60 to allow for the installation of bearing set 3 which will also be discussed in greater detail below. While only one access or bearing opening is shown, more than one could be utilized without detracting from the invention of this application.

In one set of embodiments, pocket 50 further includes a bearing surface 66 between opening 54 and the top extent. In one such embodiment, bearing surface 66 is a conical surface and will also be discussed in greater detail below. Body 1 can further include a lower surface 68 which again will be discussed in greater detail below. In addition, lower surface 68 can include an annular groove 70 extending about axis 52.

Body 1 can be formed of any material known in the industry including, but not limited to, 4140 steel, 17-4 Stainless Steel, 300 series stainless steel, metal alloys, aluminum, hard coat aluminum and even high strength polymers depending on the loads involved. Further, the body can be heat treated and/or selectively heat treated. In addition, body 1 can be a fully machined component from a block of steel and/or can be made a pre-molded, cast or forged part that has secondary operations performed to produce the desired configuration.

Post 2 extends between a first end 80 and a second end 82 and includes a post head 84 and a securing device that can be a threaded portion 86 in certain embodiments. Post 2 can further include a collar portion 90 that can be positioned between head 84 and threaded portion 86. Post 2 can also be made from any material known in the industry including, but not limited to, steel, stainless steel and metal alloys depending on the loads involved.

Head 84 can be any head known in the art and threaded portion 86 can be any securing arrangement known in the art. In this respect, securing portion 86 can take many forms including the threaded arrangement shown. This can include, but is not limited to, locking pin arrangements known in the art such as, for example only, the locking arrangements shown Hageman U.S. Pat. No. 7,914,225 and Klingenberg et al U.S. Pat. No. 7,891,903 which are both incorporated by reference herein for showing the same. Nonetheless, it has been found that a threaded arrangement is preferred while it should not be considered to be required. These other securing arrangement can include, in yet other embodiments, securing portion 86 having an internal threaded portion (shown in FIG. 6) extending into or towards post head 84 which will be discussed more below.

Head 84 can extend around a post axis 100 and further includes an outwardly facing post bearing groove 102, which at least partially extends about axis 100. However, while not required, it is preferred that groove 102 extends about the axis thereby forming an annular groove. Head 84 can further include a mating bearing surface 110 that is configured to matingly engage, at least partially, with bearing surface 66 of the post pocket. Head 84 can further include a tool receiving pocket 112 shaped to receive an associated tool (not shown) to allow for the tightening rotation of the threaded portion into a mating threaded opening (also not shown). Further, openings 26 and 56 of body 1 allow a tool to access pocket 50 and rotationally interengage pocket 112 to tighten/loosen the post when it is in the assembled position or condition shown in FIGS. 2-5.

As mentioned above, post 2 can include collar portion 90 than can have multiple functions. One such function is to prevent dirt and debris from entering into the pocket when the hoisting device is in the assembled condition. Another function can be to provide a stabilizing arrangement to at least in part stabilize the post relative to the body. In this respect, collar 90 can include (in relation to the drawings), an upwardly extending flange 120 forming an annular groove surface 122. This arrangement can work in combination with surface 68 and annular groove 70 to at least in part help guide post 2 about axis 52 of pocket 50. Further, it can help maintain alignment between post axis 100 and pocket axis 52. Further, this arrangement can work in combination with bearing surfaces 66 and 110 to create a guided fit between the post and the body. However, as will be discussed more below, the weight of the load to be supported is not supported by these surfaces, but is primarily supported by bearing arrangement within body groove 60 and post groove 102 under most circumstances.

To assemble the post into the body, post head 84 is first positioned within pocket 50. Once in position, body groove 60 is in axial alignment with post groove 102 sufficient to allow entry of one or more bearings 130. In one embodiment, body groove 60 is in substantial axial alignment with post groove 102. In another embodiment, body groove 60 is slightly misaligned axially with post groove 102. This misalignment, or angled bearing surfaces, can be used to ensure that the bearing balls seat in the grooves to properly transfer the load of the device. In this respect, the grooves can be purposely angled or misaligned in order to align the bearing balls in a specific manner, but this feature is not required. Then, bearings 130 of bearing set 3 can be fed through opening 62 and directed into an annular bearing pocket 132 formed by body groove 60 and post groove 102. Once a desired amount of bearings 130 are in bearing pocket 132, opening 62 can be sealed off with plug 5. Plug 5 can be any design known in the art and can include tamper protection features. This can include opening 62 having a ledge 142 and plug 5 being a threaded plug with a tool receiving pocket 144 that can allow the plug to be tightened against ledge 142 to create a high torque fit of the plug within the hole. Further, excess torque can be applied to the plug to damage pocket 144 such that the plug can only be removed by destroying the plug, namely, by drilling out the plug. Further, once the threaded plug is in place, the body and/or plug can be staked to either damage the plug, the plug's threads or opening 62 to prevent the removal of the plug and thus the removal of the bearing set.

As can be seen by the drawings, once the bearing set is in place in the bearing pocket, the bearing set will support the weight of any load lifted by the assembly. As a result of using the bearings set to support the weight, the post is allowed to smoothly rotation about the pocket axis even though it can support a significant amount of weight. Further, the bearings provide a high load capacity in that each bearing of the bearing set is in shear between the head and the pocket. Therefore, this arrangement both provides a robust lifting assembly and a sturdy assembly. Further, by including secondary guiding or supporting surfaces, the smoothness of the rotation of the post relative to the body can be increased without metal-on-metal contact weight carrying arrangements. Yet even further, while the bearing set supports the weight of the load, the engagement between flange 120/groove surface 122 and surface 68/annular groove 70 along with bearing surface 66 against surface 110 can help with side loads exerted on the system.

Yet even further, this ideal system can be achieved without the need for threaded collars or the like to hold the post in place in that the body includes opening 62 thereby allowing bearings 130 to be fed into the bearing groove 132 when the parts are in the assembled position.

Furthermore, by including collar 90, post 2 can be tightened against the load and can be tightened to a high torque without limiting the rotational ability of the hoisting device. In this respect, the tightening of the post can urge collar 90 into engagement with the load such that the body 1 is spaced from the load and can be allowed to rotate freely based on the bearing set within the body. This feature coupled with body 1 including tool openings 26 and 56 allow the passage of a tool into the hoist body and tighten the post into the associated load hole when the post is in the assembled condition. As can be appreciated, this allows power tools to be used to tighten the post and allows torque setting devices to torque the post to any desired torque. Further, the combinations allow the post to be tightened to the associated load with a large amount of torque without impairing the rotating ability of the hoist device. Yet further, the free rotation of the body about the post axis prevents any loosening of the system from the load.

Lifting ring 4 can be any lifting ring known in the art, including but not limited to, a shackle having a U-shaped portion 150 with a shackle pin 152. As is known in the art, portion 150 can include a pair of aligned holes 156 and 158 wherein hole 156 is a through hole and hole 158 is a threaded hole such that pin 152 can be a threaded pin with threads 160 and can pass through hole 156 and threadingly engage with hole 158. Pin 152 can further include a tool receiving aperture 162 to allow the pin to be tightened. By the arrangement shown, the hoisting device can both rotate about axis 100 and ring 4 can pivot about a ring axis 164. This arrangement provides a high degree of manipulation of the hoisting device without producing excessive loads on any one component of the device.

For the embodiments referenced below, like reference numbers are utilized for components that can be the same or similar to those referenced above.

Figure 6:
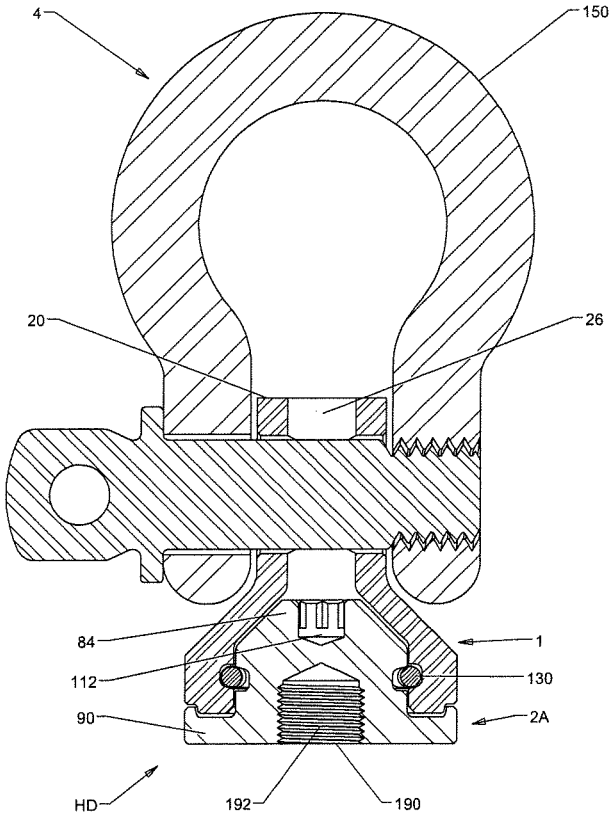
FIG. 6 is a sectional view similar to FIG. 5 wherein an internal threaded arrangement is shown.

With reference to FIG. 6, shown is a post 2A that includes an internal opening 190 having internal threads 192. Opening 190 extends inwardly from collar 90 toward tool receiving pocket 112. While not shown, opening 190 can be a part of pocket 112 wherein a single opening extends through post 2A, but could have different internal configurations based on function. Thus, device HD could be secured to a threaded post extending from an associated object. As with other embodiments, the internal thread could be tightened onto the associated post by way of tool opening 56 as is discussed in greater detail above.

Figure 7:
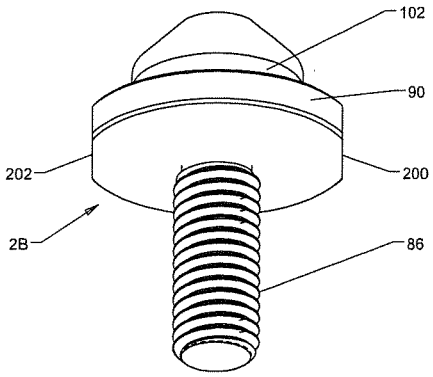
FIG. 7 is a perspective view of yet another embodiment wherein the post includes a tool receiving arrangement.

With reference to FIG. 7, shown is yet another set of embodiments according to other aspects of the invention of this application. As with other embodiments described in this application, these embodiments can be used in combination with any of the other aspects of the invention of this application. In greater detail, shown is a post 2B that includes a collar 90 having a tool receiving arrangement 200 and 202. While these tool-receiving arrangements are shown to be two opposing flats for a wrench, any tool receiving arrangement known in the art could be used for rotating post 2B relative to another object to threadingly engage the post to the object. Further, collar 90 could be an enlarged collar to allow for the use of slots 200 and 202 without effecting the internal configurations of the post and/or hoist body.

Figure 8:
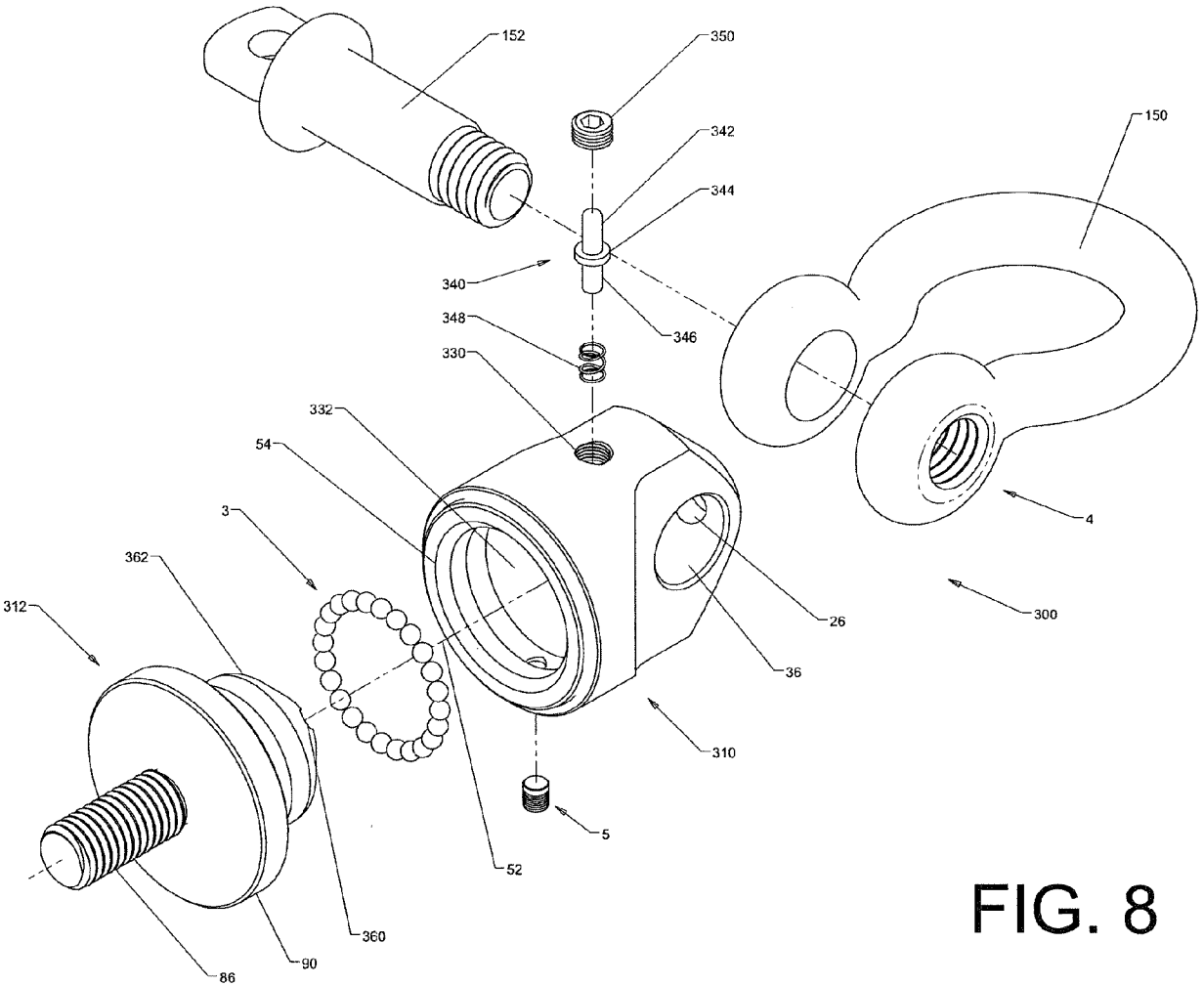
FIG. 8 is an exploded perspective view of yet another hoisting device of this application showing yet another set of embodiments that includes a locking button.
Figure 10:
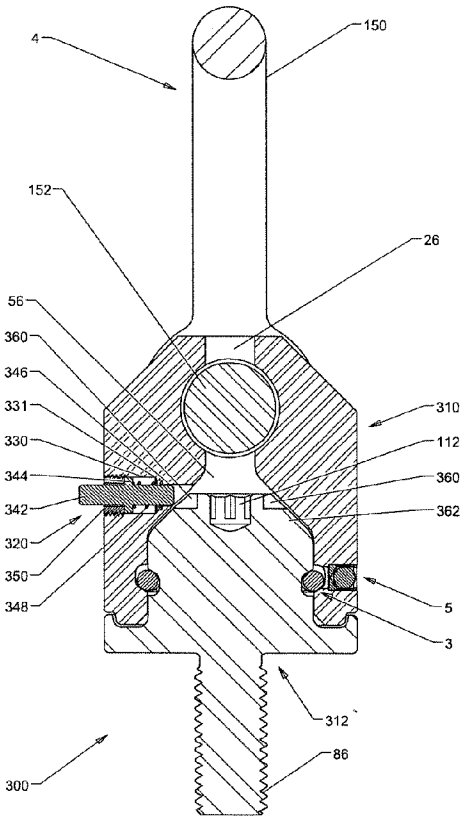
Figure 9:
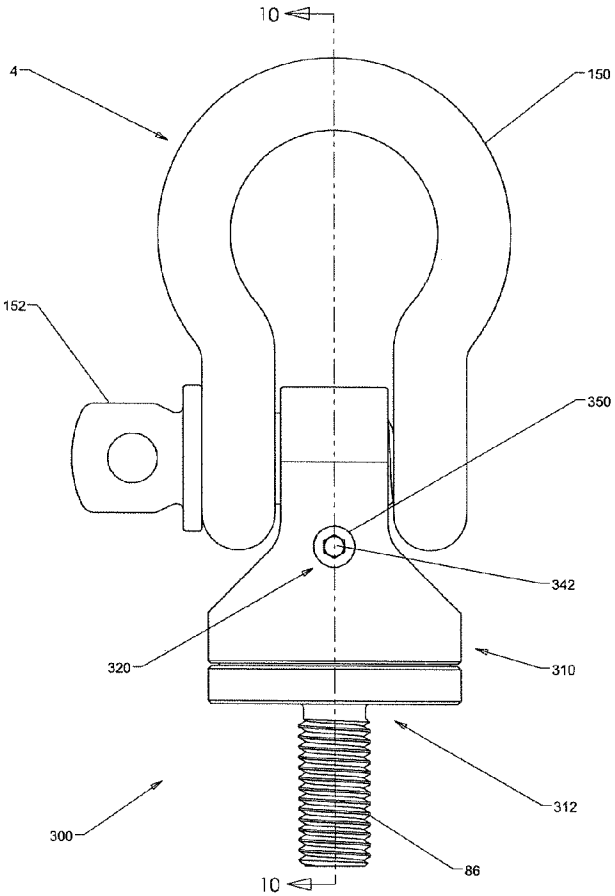
FIG. 9 is a side elevational side view of the hoisting device shown in FIG. 8; and, FIG. 10 is a sectional view taken along lines 10-10 in FIG. 9.

With reference to FIGS. 8 to 10, shown is a further set of embodiments according to yet other aspects of the invention of this application. As with other embodiments described in this application, these embodiments can be used in combination with any of the other aspects of the invention of this application. In greater detail, shown is a hoisting device 300 having a hoist body 310, a stud or post 312, a bearing set 3, a lifting ring 4 (optional), and a plug 5 wherein the much of the general structure of these components is discussed in greater detail above and will not be repeated in relation to this set of embodiments in the interest of brevity. Further, device 300 includes a push button lock arrangement 320 to allow for selective relative locking between hoist body 310 and post 312 to help secure device 300 to an associated object. In the embodiment shown, arrangement 320 is secured relative to hoist body 310 and selectively interengages with post 312, which is preferred, but not required.

More, particularly, hoist body 310 can include a second opening 330 that extends into a post pocket 332 extending about pocket axis 52. Second opening can include a bottom ledge 331 which will be discussed more below. Similar to other embodiments, pocket 332 extends from pocket opening 54 toward pocket top 55 and can include structure discussed in greater detail above and include tool opening 56 also discussed in greater details above. Second opening 330 can be a threaded opening and push button locking arrangement 320 includes a button lock pin 340 having a button portion 342, a flange 344 and an actuation pin 346. Arrangement 320 can further include a return spring 348 and an annular nut 350 which will be discussed more below. In the assembled condition, return spring 348 is positioned between ledge 331 and flange 344 wherein spring can urge pin 340 outwardly. Annular nut 350 is configured to extend about button portion 342 and to engage flange 344 to maintain pin 340 in second opening 330. In order to prevent the annular nut from loosening, any thread locking techniques known in the art can be used including, but not limited to, thread locking fluids and staking operations.

Button portion 342 is in communication with pin 346 that is shaped to be received in one of locking openings 360 wherein actuation of button portion 342 is communicated to pin 346. Locking openings can be a plurality of locking openings that are circumferentially spaced about a portion of post 312. In the configuration shown, openings 360 are circumferentially spaced about a post head 362 of post 312. As is discussed more above in relation to other embodiments, post head 362 is shaped to be received in pocket opening 332, which will not be discussed in greater detail in relation to this embodiment in the interest of brevity.

In operation, when hoist 300 is assembled and locking arrangement 320 is assembled in opening 330, the push button lock can be used to selectively lock hoist body 310 relative to post 312. This is done when button 342 is depressed and pin 346 interengages with one of openings 360 spaced about post head 362. Based on the arrangement of openings 360 and the number of openings, hoist body 310 may need to be rotated before pin 346 locates one of openings 360 wherein pin 346 will then be urged into the located opening. Return spring 348 can be used to release pin 346 from the located opening when selective locking is no longer desired. Flange 344 can be used to at least partially control the travel of the pin assembly wherein it will engage the annular nut in the unlocked condition.

Once pin 346 enters one of openings 360, the hoist body becomes locked relative to the post wherein rotation of the hoist body is transmitted to the post and this rotation can be used to thread portion 86 into an associate threaded opening (not shown). Again, threaded portion 86 can be any securing arrangement known in the art including the threaded arrangements shown. As a result, the end user of hoist 300 can use ring 4 to rotate body 310 that in turn will rotate post 312 thereby providing leverage to threadingly engage portion 86 into the associated threaded opening. This can further reduce installation time for the hoists of this application. Further, this can be used in combination with the tool receiving pocket 112 shaped to receive an associated tool (not shown) to allow for further tightening of the threaded portion into the associated opening, which was also discussed in greater detail above. Thus, button arrangement 320 can be used to fully tighten the hoist into a threaded opening and/or partially tighten the hoist into an opening with the assistance of a tightening tool.

However, it must be appreciated that openings 360 and pin 348 can be any mating arrangement for preventing relative rotation of the hoist body and post. This includes, but is not limited to, the shown openings 360 in post 312, a tooth arrangement (not shown), extensions extending from post 312 (not shown), ratcheting arrangements (single and multi-directional including a separate button for each direction) (not shown), frictional engagement (not shown), a sliding and/or rotating collar arrangement (not shown).

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation. Further, while the invention is shown and describe as more of a center-style device, it could also be used as a side-pull device and can be used in other center and/or side pull device.

It is claimed:

1. A hoisting device for use as a lifting device and/or securing device, the hoisting device comprising a hoist body having a first fastening device to secure the hoist body relative to a first associated object and an elongated post pocket extending inwardly from a first end, the post pocket having an inwardly facing body groove extending at least partially about a post pocket axis, the hoist body further comprising an outer surface with a bearing opening extending inwardly from the outer surface of the body and in communication with the body groove, the bearing opening being configured to allow passage of one or more bearings from the outer surface to the body groove, the hoisting device further includes a post having a second fastening device to secure the post relative to a second associated object and a post head, the post pocket being shaped to receive at least a portion of the post head in an assembled position, the post head including an outwardly facing post groove and the post groove being configured to functionally align with the body groove when in the assembled position within the post pocket, the post groove and the body groove together forming a bearing groove, the bearing opening allowing access to the bearing groove thereby allowing the one or more bearings to be directed into the bearing groove when the post is in the assembled position within the post pocket, the hoisting device further including a plug to close the bearing opening thereby maintaining the one or more bearings in the bearing groove, the one or more bearings in the bearing groove securing the post head within the post pocket the second fastening device includes a threaded fastening device, the post further including a tool receiving configuration to allow rotation of the post relative to the second associated object, the tool receiving configuration includes a tool receiving configuration on the post head, the hoist body further including a second end spaced from the first end, the second end including a tool passage opening providing tool access to the tool receiving configuration on the post head when the hoisting device is in the assembled position thereby allowing selective rotation of the post by an associated tool, the first fastening device includes a transverse opening that is transverse to the post pocket axis, the tool passage opening including a first and a second tool passage opening on either side of the transverse opening.

2. The hoisting device according to claim 1, wherein the one or more bearings in the bearing groove securing the post head within the post pocket allows relative rotation of the post about the post pocket axis.

3. The hoisting device according to claim 1, wherein the elongated pocket is coaxial to the post pocket axis, the inwardly facing post groove being an annular groove extending 360 degrees about the post pocket axis.

4. The hoisting device according to claim 1, wherein the threaded fastening device is a threaded post.

5. The hoisting device according to claim 1, wherein the second fastening device is a threaded opening.

6. The hoisting device according to claim 1, wherein the second fastening device further includes a collar surround the threaded fastening device.

7. The hoisting device according to claim 6, wherein the threaded fastening device is a threaded post.

8. The hoisting device according to claim 1, wherein the first fastening device further includes a ring selectively attachable to the transverse opening.

9. The hoisting device according to claim 1, wherein the one or more bearings are a plurality of spherical ball bearings.

10. A hoisting device for use as a lifting device and/or securing device, the hoisting device comprising a hoist body having a first fastening device to secure the hoist body relative to a first associated object and an elongated post pocket extending inwardly from a first end, the post pocket having an inwardly facing body groove extending at least partially about a post pocket axis, the hoist body further comprising an outer surface with a bearing opening extending inwardly from the outer surface of the body and in communication with the body groove, the bearing opening being configured to allow passage of one or more bearings from the outer surface to the body groove, the hoisting device further includes a post having a second fastening device to secure the post relative to a second associated object and a post head, the post pocket being shaped to receive at least a portion of the post head in an assembled position, the post head including an outwardly facing post groove and the post groove being configured to functionally align with the body groove when in the assembled position within the post pocket, the post groove and the body groove together forming a bearing groove, the bearing opening allowing access to the bearing groove thereby allowing the one or more bearings to be directed into the bearing groove when the post is in the assembled position within the post pocket, the hoisting device further including a plug to close the bearing opening thereby maintaining the one or more bearings in the bearing groove, the one or more bearings in the bearing groove securing the post head within the post pocket, the post extends between a first post end and a second post end, the second fastening device facing the second post end and the post head facing the first post end, the post head including a conical post portion and a cylindrical post portion, the cylindrical post portion including the outwardly facing post groove, the elongated post pocket including a conical pocket portion shaped to receive the conical post portion.

11. The hoisting device according to claim 10, wherein the conical post portion is adjacent to the first post end and the cylindrical post portion is between the conical portion and the second post end, the post further including a collar adjacent to the cylindrical post portion, the collar being larger than the elongated post pocket and covering the elongated post pocket.

12. The hoisting device according to claim 11, wherein the collar has a circumferential edge and the edge includes a flange facing the first end and partially forming an annular groove facing the first end, the hoist body including a ridge and the ridge at least partially penetrating the annular groove when in the assembled position.

13. A hoisting device for use as a lifting device and/or securing device, the hoisting device comprising a hoist body having a first fastening device to secure the hoist body relative to a first associated object and an elongated post pocket extending inwardly from a first end, the post pocket having an inwardly facing body groove extending at least partially about a post pocket axis, the hoist body further comprising an outer surface with a bearing opening extending inwardly from the outer surface of the body and in communication with the body groove, the bearing opening being configured to allow passage of one or more bearings from the outer surface to the body groove, the hoisting device further includes a post having a second fastening device to secure the post relative to a second associated object and a post head, the post pocket being shaped to receive at least a portion of the post head in an assembled position, the post head including an outwardly facing post groove and the post groove being configured to functionally align with the body groove when in the assembled position within the post pocket, the post groove and the body groove together forming a bearing groove, the bearing opening allowing access to the bearing groove thereby allowing the one or more bearings to be directed into the bearing groove when the post is in the assembled position within the post pocket, the hoisting device further including a plug to close the bearing opening thereby maintaining the one or more bearings in the bearing groove, the one or more bearings in the bearing groove securing the post head within the post pocket, the hoisting device further including a spring loaded locking feature actuatable between a locked condition and an unlocked condition, when in the locked condition, the locking feature preventing relative rotation between the hoist body and the post such that rotation of the hoist body is transmitted to the post, when in the unlocked condition, the hoist body moving relative to the post.

14. A hoisting device for use as a lifting device and/or securing device, the hoisting device comprising a hoist body having a first fastening device to secure the hoist body relative to a first associated object and an elongated post pocket extending inwardly from a first end, the post pocket having an inwardly facing body groove extending at least partially about a post pocket axis, the hoist body further comprising an outer surface with a bearing opening extending inwardly from the outer surface of the body and in communication with the body groove, the bearing opening being configured to allow passage of one or more bearings from the outer surface to the body groove, the hoisting device further includes a post having a second fastening device to secure the post relative to a second associated object and a post head, the post pocket being shaped to receive at least a portion of the post head in an assembled position, the post head including an outwardly facing post groove and the post groove being configured to functionally align with the body groove when in the assembled position within the post pocket, the post groove and the body groove together forming a bearing groove, the bearing opening allowing access to the bearing groove thereby allowing the one or more bearings to be directed into the bearing groove when the post is in the assembled position within the post pocket, the hoisting device further including a plug to close the bearing opening thereby maintaining the one or more bearings in the bearing groove, the one or more bearings in the bearing groove securing the post head within the post pocket, a locking feature actuatable between a locked condition and an unlocked condition, when in the locked condition, the locking feature preventing relative rotation between the hoist body and the post such that rotation of the hoist body is transmitted to the post, when in the unlocked condition, the hoist body moving relative to the post, the locking feature includes an actuation button fixed relative to the hoist body and a locking pin in communication with the actuation button, the post include at least one locking feature shaped to receive the locking pin to prevent the relative rotation.

15. The hoisting device according to claim 14, wherein the at least one locking feature includes a plurality of openings circumferentially spaced about a post axis, each of the plurality of openings being shaped to receive the locking pin to prevent the relative rotation.

16. A hoisting device for use as a lifting device and/or securing device, the hoisting device comprising a hoist body having a first fastening device to secure the hoist body relative to a first associated object and an elongated post pocket extending inwardly from a first end, the post pocket having an inwardly facing body groove extending at least partially about a post pocket axis, the hoist body further comprising an outer surface with a bearing opening extending inwardly from the outer surface of the body and in communication with the body groove, the bearing opening being configured to allow passage of one or more bearings from the outer surface to the body groove, the hoisting device further includes a post having a second fastening device to secure the post relative to a second associated object and a post head, the post pocket being shaped to receive at least a portion of the post head in an assembled position, the post head including an outwardly facing post groove and the post groove being configured to functionally align with the body groove when in the assembled position within the post pocket, the post groove and the body groove together forming a bearing groove, the bearing opening allowing access to the bearing groove thereby allowing the one or more bearings to be directed into the bearing groove when the post is in the assembled position within the post pocket, the hoisting device further including a plug to close the bearing opening thereby maintaining the one or more bearings in the bearing groove, the one or more bearings in the bearing groove securing the post head within the post pocket, the post pocked and head being shaped to prevent exact alignment between the post groove and the body groove such that the functional alignment of the bearing groove is an axial misalignment between the post groove and the body groove wherein the post pocket is shaped to create the axial misalignment by restricting the portion of the post head that can enter the post pocket such that the post grove is closer to the first end of the post pocket than the body grove when in the assembled position and the axial misalignment being maintained whether or not an associated load is applied to the hoisting device, the axial misalignment to seat the one or more bearings in the bearing groove.

17. A method of assembling a hoisting device for use as a lifting device and/or securing device, the method including the steps of:

providing a hoist body having a first fastening device to secure the body relative to a first associated object and an elongated post pocket extending inwardly from a first end, the post pocket having an inwardly facing body groove extending at least partially about a post pocket axis, the hoist body further comprising an outer surface with a bearing opening extending inwardly from the outer surface of the body and in communication with the body groove, the bearing opening being configured to allow the passage of one or more bearings from the outer surface to the body groove;

providing a post having a second fastening device to secure the post relative to a second associated object and a post head and the post pocket being shaped to receive at least a portion of the post head in an assembled position, the post head including an outwardly facing post groove and the post groove being configured to functionally align with the body groove when in the assembled position within the post pocket;

providing a plurality of bearings;

providing a plug to selectively close the bearing opening;

assembling the post and hoist body into the assembled position by positioning the post head into the post pocket such that the post groove and the body groove together form a bearing groove;

inserting the plurality of bearings into the bearing opening to at least partially fill the bearing groove;

securing the plug in the bearing opening to maintain the plurality of bearings within the bearing groove, the plurality of bearings in the bearing groove securing the post head within the post pocket; and providing a tool receiving configuration on the post head and providing a tool passage opening in the hoist body thereby allowing selective rotation of the post, wherein the first fastening device includes transverse opening that is transverse to the post pocket axis, the tool passage opening including a first and a second tool passage opening on either side of the transverse opening.

18. The method according to claim 17, further including the steps of providing a ring selectively attachable to the transverse opening and securing the ring to the transverse opening.

19. A hoisting device for use as a lifting device and/or securing device, the hoisting device comprising a hoist body having a first fastening device to secure the hoist body relative to a first associated object and an elongated post pocket extending inwardly from a first end, the hoist body further including a second end spaced from the first end, the post pocket having an inwardly facing body groove extending at least partially about a post pocket axis, the hoist body further comprising an outer surface with a bearing opening extending inwardly from the outer surface of the body and in communication with the body groove, the bearing opening being configured to allow passage of one or more bearings from the outer surface to the body groove, the hoisting device further includes a post having a second fastening device that includes a threaded arrangement to threadingly secure the post relative to a second associated object and a post head, the post head having a tool receiving configuration to allow rotation of the post relative to the second associated object, the post pocket being shaped to receive at least a portion of the post head in an assembled position wherein the tool receiving configuration is within the post pocket, the second end including a tool passage opening providing tool access to the post pocket and the tool receiving configuration on the post head within the post pocket when the hoisting device is in the assembled position thereby allowing selective rotation of the post by an associated tool, the post head including an outwardly facing post groove and the post groove being configured to functionally align with the body groove when in the assembled position within the post pocket, the post groove and the body groove together forming a bearing groove, the bearing opening allowing access to the bearing groove thereby allowing the one or more bearings to be directed into the bearing groove when the post is in the assembled position within the post pocket, the hoisting device further including a plug to close the bearing opening thereby maintaining the one or more bearings in the bearing groove, the one or more bearings in the bearing groove securing the post head within the post pocket.

* * * * *